US005664376A

United States Patent [19]

Wilson et al.

[11] Patent Number: 5,664,376

[45] Date of Patent: *Sep. 9, 1997

[54] CORNER POST SUPPORT MEMBER

[75] Inventors: Richard C. Wilson, West Bloomfield, Mich.; Patrick M. Culpepper, Dover, Ohio

[73] Assignee: Abco, Inc., New Philadelphia, Ohio

[ * ] Notice: The term of this patent shall not extend beyond the expiration date of Pat. No. 5,542,222.

[21] Appl. No.: 639,698

[22] Filed: Apr. 29, 1996

Related U.S. Application Data

[63] Continuation of Ser. No. 355,471, Dec. 14, 1994, Pat. No. 5,542,222.

[51] Int. Cl.[6] ..... E04B 2/00

[52] U.S. Cl. ..... 52/287.1; 52/288.1; 52/716.1

[58] Field of Search ..... 52/288.1, 309.9, 52/287.1, 276, 309.8, 716.1, 718.01

[56] References Cited

U.S. PATENT DOCUMENTS

| | | | |
|---|---|---|---|
| 274,947 | 7/1883 | Culpepper et al. | D52/73 |
| 2,091,316 | 8/1937 | Hauck | 20/4 |
| 2,373,789 | 4/1945 | Smith | 20/4 |
| 3,500,600 | 3/1970 | Bagley, Sr. | 52/211 |
| 3,525,188 | 8/1970 | Turbett | 52/288 |
| 3,826,054 | 7/1974 | Culpepper et al. | 52/309 |
| 3,828,499 | 8/1974 | Leddy | 52/278 |
| 4,033,802 | 7/1977 | Culpepper et al. | 156/71 |
| 4,081,939 | 4/1978 | Culpepper et al. | 52/535 |
| 4,189,885 | 2/1980 | Fritz | 52/287 |
| 4,319,439 | 3/1982 | Gussow | 52/288 |
| 4,506,486 | 3/1985 | Culpepper et al. | 52/529 |
| 4,827,683 | 5/1989 | Poole | 52/287.1 X |
| 4,949,520 | 8/1990 | Bear | 52/281.1 |
| 5,090,174 | 2/1992 | Fragale | 52/309.9 |

FOREIGN PATENT DOCUMENTS

| | | |
|---|---|---|
| 1354483 | 5/1974 | United Kingdom . |

*Primary Examiner*—Kien T. Nguyen
*Attorney, Agent, or Firm*—Young & Basile, P.C.

[57] ABSTRACT

A support member for a siding corner post which is spaced from the outer corner of a building to form a longitudinally extending hollow space within which the support member is located.

4 Claims, 2 Drawing Sheets

CORNER POST SUPPORT MEMBER

This application is a continuation of application Ser. No. 08/355,471, filed on Dec. 14, 1994 now U.S. Pat. No. 5,542,222.

FIELD OF THE INVENTION

The present invention relates broadly to composite non-structural siding corner posts and more particularly, to a support member formed of a suitable material, such as polystyrene foam or the like, and adapted to be disposed between the inner surfaces of a siding corner post and an exterior corner of a building structure.

BACKGROUND OF THE INVENTION

Heretofore, siding corner posts have been constructed of various materials, such as aluminum, steel, wood or vinyl. The conventional siding corner post which is attached directly to the corner of the building lacks structural rigidity and impact resistance. Furthermore, the conventional siding corner post is open through its longitudinally extending center creating ideal locations for insects or birds to build nests.

One commercially available product is a snap-in-place plastic spacer in the form of a reinforcing rib which is inserted within the siding corner post. The spacers do not connect to one another and therefore do not create a system of overall rigidity and impact resistance.

It is also known to use foam inserts in conjunction with conventional siding panels, see for example U.S. Pat. Nos. 4,506,486; 4,033,802; 4,081,939 and U.S. Pat. No. Des. 274,947. U.S. Pat. No. 4,081,939 describes a backer board for siding panels that is used to insulate and provide support to the siding panels. The siding panel backer board is placed between the inner surface of the siding panels and the exterior surface of the building, but are not designed to support the corner post.

Other parts associated with the conventional siding corner posts include channel members, finishings, and corner assemblies, see for example U.S. Pat. Nos. 4,189,885; 4,319,439; 3,828,499; 3,525,188 and 3,500,600. Although the inventions described in these patents involve the siding corner post or area of siding, the disclosures still leave the siding corner post hollow.

Known corner posts for a building can be found in U.S. Pat. Nos. 2,373,789; 2,091,316 and 3,826,054. These patents involve the creation of a solid corner post for building structures, and do not deal with the aforementioned problems of conventional siding and, in particular, the siding corner post.

As aforementioned, the known corner structure provides no longitudinally continuous system of support for a conventional siding corner post. The siding corner post which is left hollow lacks structural rigidity and support, is easily damaged, warped and twisted, and presents an ideal location for birds and insects to build nests.

SUMMARY OF THE INVENTION

The present invention, which will be discussed in greater detail hereinafter, includes a support member adapted for use in conjunction with a corner post for conventional siding wherein the support member is formed integrally with two portions which merge angularly to compliment the interior of the siding corner post and extend longitudinally the length of that corner post, filling the space between the siding corner post and the exterior wall of a building. The support member creates a system of continuous support for the siding corner post as well as improving impact resistance and rigidity. The support member also deters birds and insects from nesting in the siding corner piece. This embodiment is ideal when used in new construction.

In a preferred embodiment, it is desirable to provide a support member for siding corner posts wherein the support member is fabricated from an insulating material in the nature of a polystyrene foam plastic or the like.

It is further desirable in the present invention to provide a support member of the type described which has flanges that extend from the corner post base and abut the backer boards for the siding panels. The siding corner post which is attached to the exterior of the building, allows the siding panels to fit into the corner post such that the support member flange supports both the siding panel and the corner post flange until it meets the siding panel backer board. Similarly, the support member flanges are suitable to abut sheets of underlayment that are placed in sheets beneath conventional siding.

It is further desirable in this invention to provide a support member for siding corner posts which is simple in its construction and inexpensive to manufacture.

Further objects, advantages, and applications of the present invention will become apparent to those skilled in the art when the accompanying description of several examples of the best modes contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DESCRIPTION OF THE PREFERRED EMBODIMENT

Figure 1:
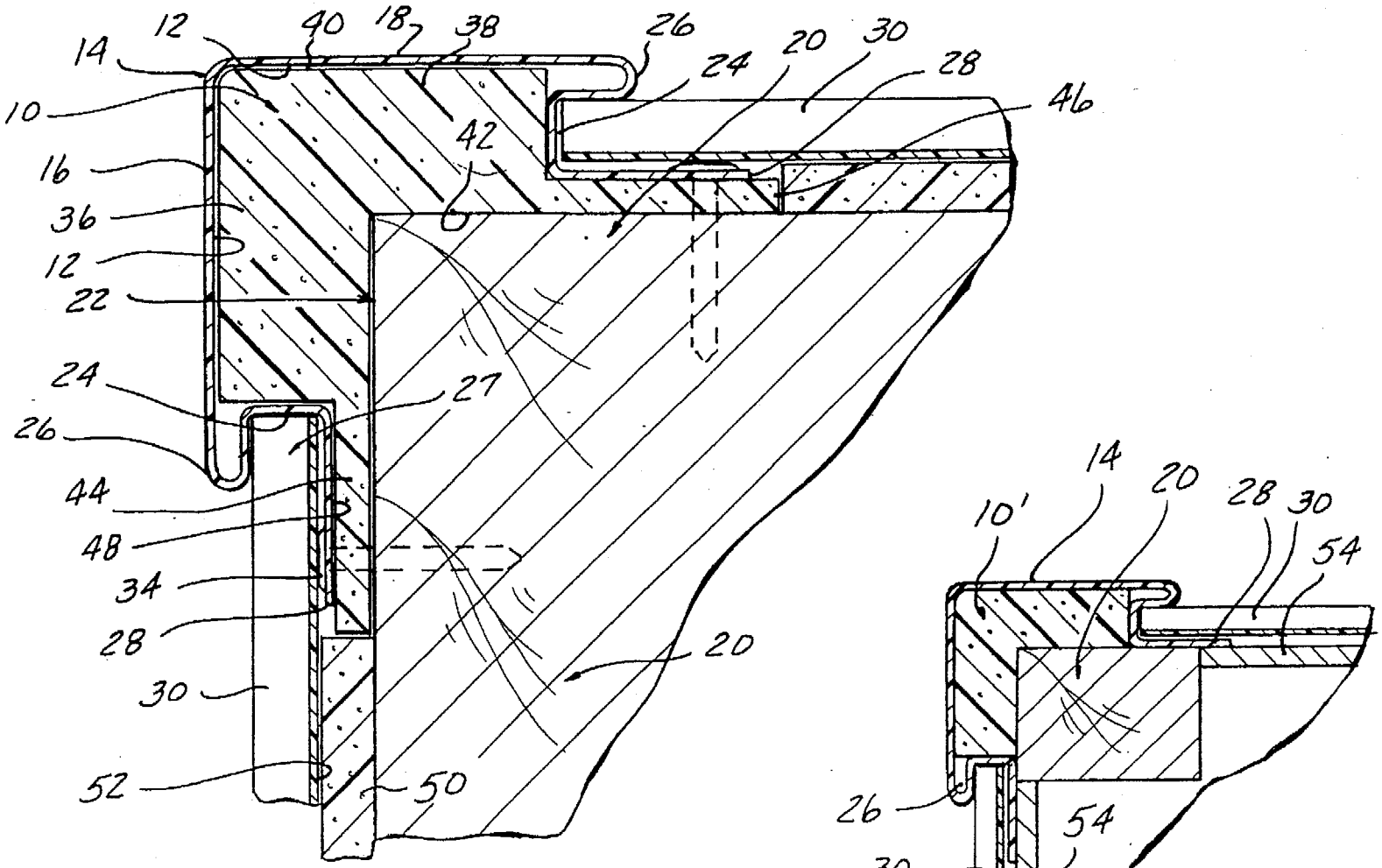
FIG. 1 is a cross-sectional view taken as shown in FIG. 3 of the siding corner post having a corner support member adjacent to the siding panel and corresponding siding backer board.

Referring now to the drawings, and in particular to FIG. 1, wherein there is illustrated one example of the present invention in the form of a support member 10 located against the inside surface 12 of a conventional siding corner post 14. The conventional siding corner post 14 is fabricated from a sheet of material, such as aluminum, steel, or vinyl. If desired, the material siding may be coated with a protective finish, such as baked enamel. The siding corner post 14 includes two siding walls 16 and 18 that converge angularly at the exterior corner of the building 20, leaving a triangular gap between the siding corner post 14 and the exterior wall surface 22 of the building 20, in which the corner support member 10 is inserted. The base 24 of the siding corner post 14 is recessed between a lip 26 and a flange 28 to form a pocket 27 so that the siding panel 30 can fit securely within the siding corner post pocket 27 giving an attractive finished appearance by hiding the cut end of the Siding panel beneath the lip 26. The building corner 20 is illustrated as an outside corner, however, it should be understood that the present invention is equally applicable to inside building corner construction.

Figure 3:
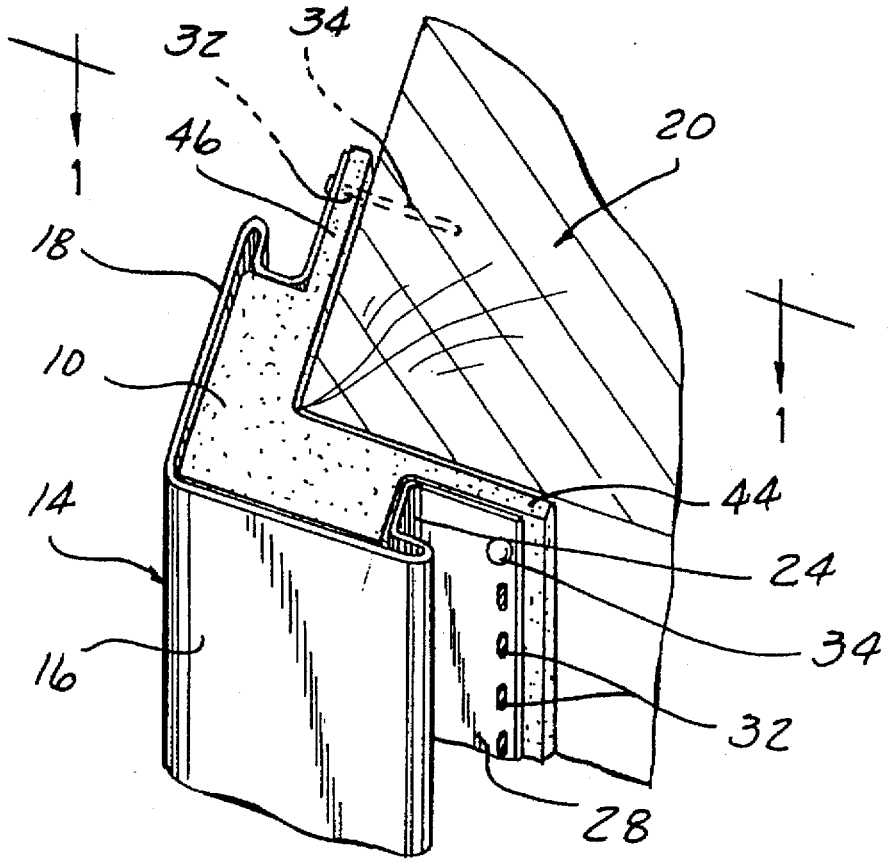
FIG. 3 is a fragmentary perspective view of the siding corner post having a support member constructed in accordance with the principles of the present invention.
Figure 4:
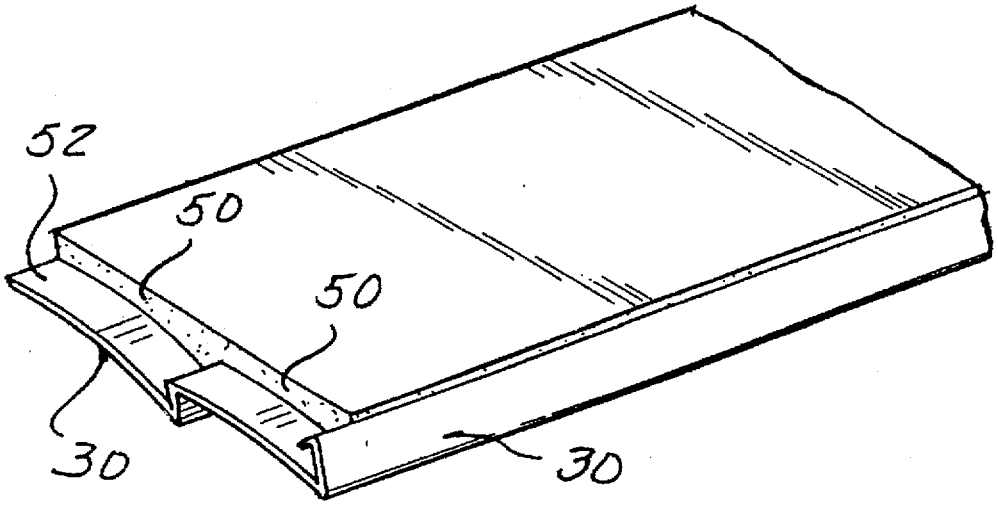
FIG. 4 is a fragmentary perspective view of the siding panel having a backer board for the purposes of illustrating inserts used for conventional siding panels.

As seen in FIG. 3, the flange 28 extends from the siding corner post pocket 27 and has nailing slots 32 spaced longitudinally along the siding corner post 14. The apertures 32 provide means for securing the siding corner post 14 against the building structure 20 with fastener 34, such as a nail.

Referring back to FIG. 1, the corner support member 10 has two elongated portions 36 and 38 angularly disposed with respect to one another to conform to the shape of the siding corner post 14. The portions 36 and 38 extend longitudinally through the siding corner post 14. The corner support member 10 is conformed in shape such that it fits securely in the gap between the inner surface 12 of the siding corner post 14 and the exterior wall 22 of the building 20. Therefore, it is preferred that the inner surface 12 of the siding corner post 14 abuts against the externally facing surface 40 of the corner support member 10, and inner surface 42 of the corner support member 10 abuts against the exterior wall 22 of the building structure 20.

Figure 2:
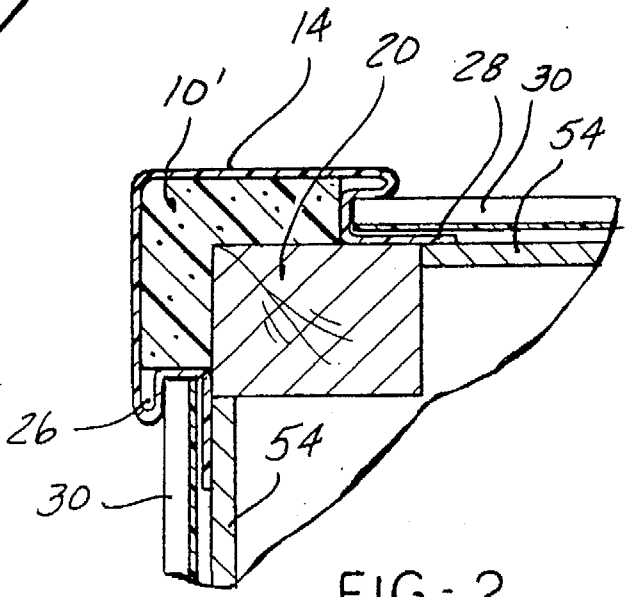
FIG. 2 is a cross-sectional view taken of the siding corner post having corner support member in new construction.

FIG. 2 illustrates the siding corner post 14 interlocking with the siding panels 30 in new construction wherein the siding panels 30 attach directly to the oriented strand board 54 or other surface such as the exterior wall 22. The corner support member 10 fills the siding corner post 14 to provide continuous structural rigidity and support. The support member 10, as shown in FIG. 2, does not provide flanges so that the siding corner post flanges 28 attach directly to the oriented strand board 54 or the exterior wall 22, as desired.

In the preferred embodiment, (FIG. 1), the corner support member 10 has two flanges 44 and 46 extending outwardly from the support member portions 36 and 38 at the base 24 of the siding corner post 14. The flanges 44 and 46 conform to the shape of the space between the inner surface of the corner post flange 48 and the exterior wall 22, and extend longitudinally along the siding corner post 14.

In the preferred embodiment, the flanges 44 and 46 extend past the siding corner post flange 28 so that the support member flanges 44 and 46 are in such a position as to abut a siding backer board 50. (The numeral 50 will also designate where a sheet of underlayment is used in place of a siding backer board) This provides a snug fit of the corner piece support member 10 and the siding panel backer board 50 for improved insulation characteristics and an overall rigid condition in the siding system, 14 and 30, that covers the building 20. The siding panel backer board is disclosed in U.S. Pat. Nos. 4,033,802; 4,081,939; 4,506,456; and U.S. Pat. No. Des. 274,947, which are incorporated by reference herein.

The siding panel backer board or underlayment 50 is placed between the inner surface 52 of the siding panels 30 and the exterior wall surface 22 of the building 20 and functions to insulate and provide support to the siding panels 30. Similarly, the preferred embodiment also includes a siding arrangement where a sheet of underlayment is attached to the exterior wall, and used in lieu of siding panel backer boards.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A support member for a corner post made of thin sheet material and used to enclose the corner of an external wall of a building, the corner post being spaced from the external wall to define a longitudinally extending hollow space therebetween, said support member comprising:

a single member having first and second longitudinally extending portions, the first portion lying in a first plane angularly disposed with respect to the second portion lying in a second plane, wherein said first and second longitudinally extending portions have lengths corresponding to the length of the corner of the building and wherein said single member defines a cornered inner surface for contacting the building and a spaced apart cornered outer surface for contacting the corner post;

a first support member flange extending outwardly from said first portion a predetermined distance and extending continuously along the entire length of said first portion and from said inner surface radially outwardly; and a second support member flange extending outwardly from said second portion a predetermined distance and extending continuously along the entire length of said second portion, wherein said first and second support member flanges extend from said inner surface radially outwardly.

2. The support member of claim 1 wherein said:

support member is fabricated from a material having insulating qualities.

3. The support member of claim 2 wherein said material is selected from the group consisting of expanded, extruded or molded polystyrene foam plastic.

4. The support member of claim 1 wherein the support member has a length and thickness corresponding to and for filling the hollow space between the corner post and the external wall of the building along the entire length of the corner of the building.

* * * * *